US006299373B1

(12) United States Patent
Cheng

(10) Patent No.: US 6,299,373 B1
(45) Date of Patent: Oct. 9, 2001

(54) RING ASSEMBLY FOR A PEN

(75) Inventor: Jason Cheng, San-Chung (TW)

(73) Assignee: Ding Ares Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/812,086

(22) Filed: Mar. 19, 2001

(51) Int. Cl.[7] ..... B43K 29/007; B43K 29/00; G09F 3/04; G09F 3/16

(52) U.S. Cl. ..... 401/195; 40/334; 40/594; 40/660; 40/905; 434/391

(58) Field of Search ..... 401/195, 52; 40/334, 40/594, 660, 665, 905; 434/391

(56) References Cited

U.S. PATENT DOCUMENTS 1,085,386 * 1/1914 Leitschuh ..... 40/334
1,262,788 * 4/1918 Heidenreich ..... 40/334
1,387,625 * 8/1921 Stein ..... 40/334
2,111,518 * 3/1938 Wallace ..... 40/334

* cited by examiner

*Primary Examiner*—Gregory L. Huson
*Assistant Examiner*—Kathleen J. Prunner
(74) *Attorney, Agent, or Firm*—Alan Kamrath; Rider, Bennett, Egan & Arundel, LLP

(57) ABSTRACT

A ring assembly for a pen has a bottom ring, a top ring, and a slender bridge connecting the bottom ring and the top ring. In assembly, a barrel of the pen extends through the bottom ring and the top ring, so that a sticker adhered around the barrel is securely attached to the barrel by clamping of the top ring and the bottom ring. Furthermore, a gap formed by two conjunct sides of the sticker is concealed by the bridge. By such arrangement, the ring assembly is able to be decorative and to avoid peeling of the sticker from the barrel after long-term use.

14 Claims, 3 Drawing Sheets

RING ASSEMBLY FOR A PEN

BACKGROUND OF THE INVENTION

1. Field of the Invention

The present invention relates to a ring assembly, and more particularly to a ring assembly for a pen, wherein adhesion of a decorative sticker of a barrel of the pen is reinforced, a gap between two conjunct sides of the sticker is concealed, and the aesthetic appeal of the pen is enhanced by the appearance of the ring assembly.

2. Description of Related Art

Pens are widely used nowadays for writing, marking, drawing, etc., and one kind of conventional pen commonly used is shown in FIG. 5. The pen has a barrel (50), a sticker (51) adhered around an outer surface of the barrel (50), and a gap (501) defined between opposed ends of the sticker (51) which are conjunct when the sticker is adhered to the pen. The sticker (51) has a certain pattern in order to provide decorative or commercial meanings. When adhering the sticker (51) onto the barrel (50), the gap (501) is usually formed because an exact abutment of the two conjunct sides of the sticker (51) is seldom possible in mass production of the pens. After long-term use of the pen, the sticker (51) easily begins to peel off from the barrel (50) starting from the gap (510), due to the rubbing of a user's fingers against the sticker (51). Thus, the intention of providing the sticker is overcome as the pen will not have an attractive appearance and any message may no longer be legible.

Another kind of conventional pen (not shown) commonly used has a pattern printed directly onto a barrel. However, the method of printing the pattern directly onto the barrel is only able to print a simple pattern which may lose integrity after long-term use of the pen, and thus the pattern will become meaningless and unattractive.

To overcome the shortcomings, the present invention tends to provide a ring assembly for a pen to mitigate or obviate the aforementioned problems.

SUMMARY OF THE INVENTION

The primary objective of the present invention is to provide a ring assembly for a pen, such that a sticker is securely adhered around a barrel of the pen by extending the barrel through the ring assembly.

Another object of the present invention is to provide a ring assembly for a pen which has a bridge to conceal a gap defined by conjunct sides of the sticker and to avoid peeling of the sticker which usually starts from the gap.

In accordance with one aspect of the invention, the ring assembly for the pen has a top ring, a bottom ring, and a bridge connecting the top ring and the bottom ring. A barrel having a sticker adhered around as a skin of the barrel extends through the ring assembly, so the sticker is clamped securely to the barrel by the top ring and the bottom ring, and the bridge is able to provide hiding for a gap defined by conjunct sides of the sticker.

Other objects, advantages and novel features of the invention will become more apparent from the following detailed description when taken in conjunction with the accompanying drawings.

DETAILED DESCRIPTION OF THE PREFERRED EMBODIMENT

Figure 1:
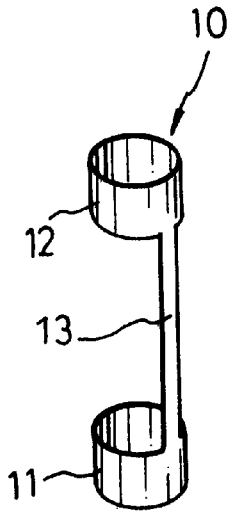
FIG. 1 is a perspective view of the ring assembly in accordance with the present invention.

With reference to FIG. 1, a ring assembly (10) for a pen in accordance with the present invention includes a bottom ring (11), a top ring (12), and a bridge (13) securely connecting the bottom ring (11) and the top ring (12).

Figure 2:
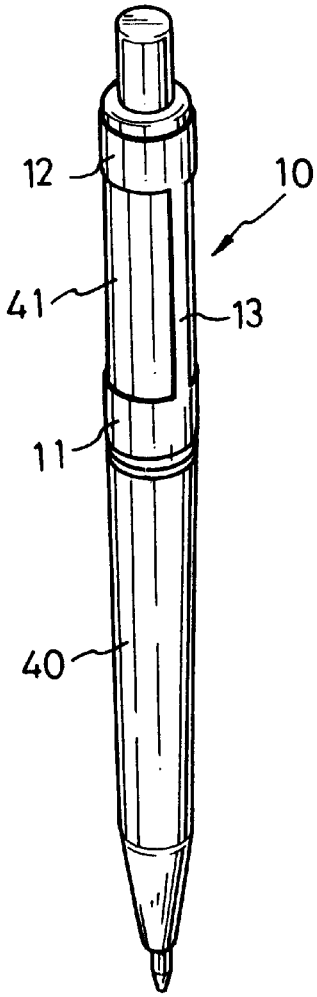
FIG. 2 is a perspective view of a preferred embodiment, wherein the ring assembly is assembled onto a pen and a sticker.
Figure 5:
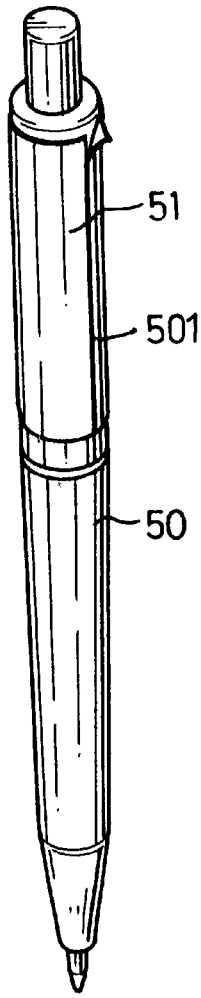
FIG. 5 PRIOR ART
FIG. 5 is a perspective view of a conventional pen.
Figure 3:
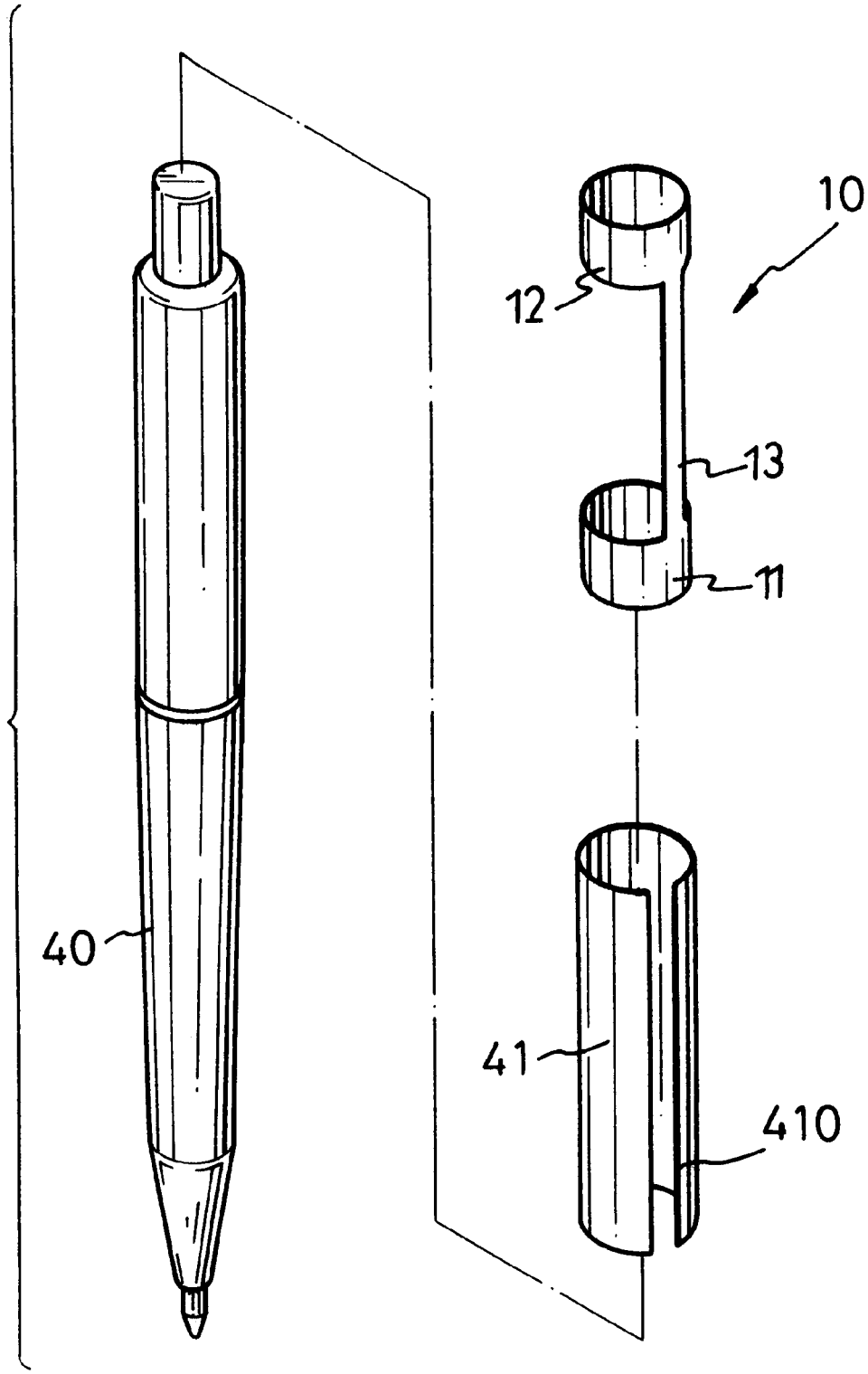
FIG. 3 is an exploded perspective view of the preferred embodiment of the ring assembly together with the pen and the sticker.

In a preferred embodiment as shown in FIGS. 2 and 3, the bottom ring (11) and the top ring (12) both are hollow cylinders with the same inner diameter formed to correspond to an outer diameter of a barrel (40) with a sticker (41) adhered around the barrel (40) as a skin of a pen. The ring assembly (10) may be manufactured as a single piece in a molding process.

A gap (410) is commonly formed because the exact butting of two conjunct sides of the sticker (41) is very difficult in mass production of pens. Centers of the bottom ring (11) and the top ring (12) are co-axially defined on a longitudinal axis of the barrel (40), and the connecting bridge (13) is parallel to the longitudinal axis of the barrel (40).

In assembly, the sticker (41) with a desired pattern is adhered around the barrel (40) of the pen. The ring assembly (10) is mounted onto the pen by the sequence of first extending a top-end of the barrel (40) through the bottom ring (11) then the top ring (12), and finally adjusting the bridge (13) to conceal the gap (401) between the two conjunct sides of the sticker (41).

Figure 4:
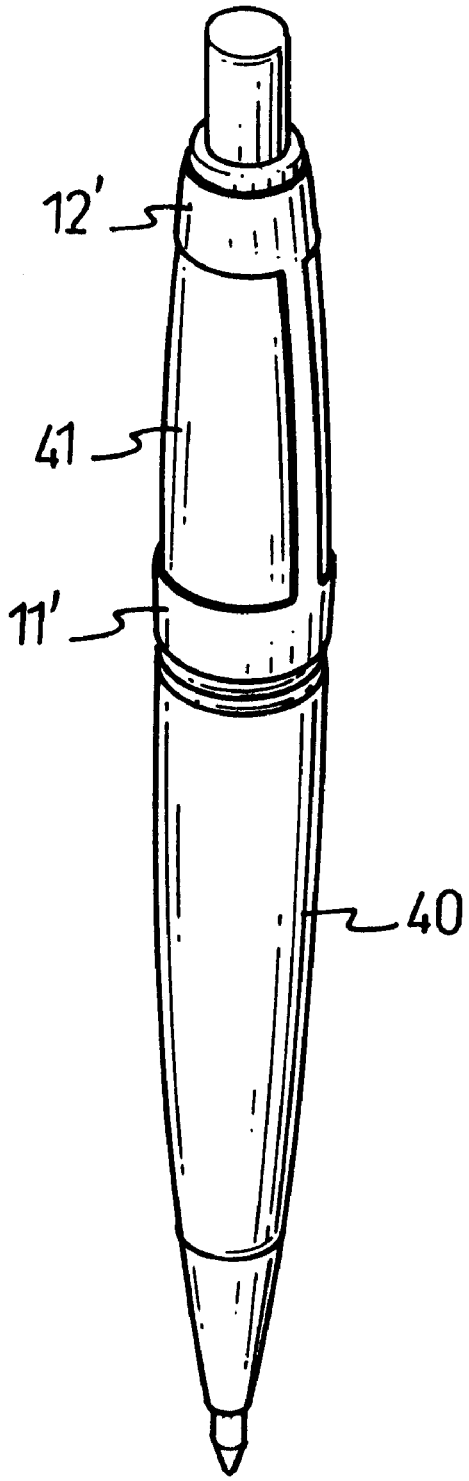
FIG. 4 is a perspective view of a second preferred embodiment, wherein a ring assembly is assembled onto a pen and a sticker.

A manufacturer may produce a range of pens with different diameter barrels or pens with barrels each having more than one size diameter, for example, the barrel with smaller diameters at two end portions and a bigger diameter at a center portion. Thus, in a second embodiment shown in FIG. 4, the diameters of the bottom ring (11') and the top ring (12') may be different in order to correspond to the variant diameters of the barrel (40).

From the above description, it is noted that the invention has the following advantages:

1. The ring assembly (10) is able to securely reinforce the attachment of the sticker (41) onto the barrel (40) to prevent peeling off of the sticker after long-term use of the pen.
2. The bridge (13) of the ring assembly (10) is able to conceal the gap (410), in order to enhance the appearance of the pen, and also to avoid peeling of the sticker from the gap (410) where the peeling usually starts.
3. The invention is able to form a decorative pattern on the pen, and the pattern is not limited to the simple pattern directly printed onto the barrel (40)
4. The invention is able to form the decorative pattern on the pen, and the integrity of the pattern will not be easily lost through long-term use and rubbing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ring assembly for a pen with a sticker adhered around a barrel of the pen, comprising:

a bottom ring, a top ring, and at least one bridge securely connecting the bottom ring and the top ring, wherein the bottom ring and the top ring each have an inner diameter the same as the other and are so configured that after the extension of the barrel of the pen and the adhesion of the sticker to the barrel, the ring assembly is able to clamp the barrel.

2. The ring assembly as claimed in claim 1, wherein the bridge is adapted to conceal a gap defined by two conjunct sides of the sticker after the sticker is adhered to the barrel.

3. The ring assembly as claimed in claim 2, wherein the bridge is formed parallel to a longitudinal axis between the bottom ring and the top ring.

4. The ring assembly as claimed in claim 2, wherein the bottom ring, the top ring, and the bridge are in one piece.

5. The ring assembly as claimed in claim 1, wherein the bridge is formed parallel to a longitudinal axis between the bottom ring and the top ring.

6. The ring assembly as claimed in claim 5, wherein the bottom ring, the top ring, and the bridge are in one piece.

7. The ring assembly as claimed in claim 1, wherein the bottom ring, the top ring, and the bridge are in one piece.

8. A ring assembly for a pen with a sticker adhered around a barrel of the pen, comprising:

a bottom ring, a top ring, and at least one bridge securely connecting the bottom ring and the top ring, wherein the bottom ring and the top ring each have an inner diameter different from each other and are so configured that after the extension of the barrel of the pen and the adhesion of the s ticker to barrel, the ring assembly is able to clamp the barrel.

9. The ring assembly as claimed in claim 8, wherein the bridge is adapted to conceal a gap formed by two conjunct sides of the sticker.

10. The ring assembly as claimed in claim 9, wherein the bridge is formed parallel to a longitudinal axis of the bottom ring and the top ring.

11. The ring assembly as claimed in claim 9, wherein the bottom ring, the top ring, and the bridge are in one piece.

12. The ring assembly as claimed in claim 8, wherein the bridge is formed parallel to a longitudinal axis of the bottom ring and the top ring.

13. The ring assembly as claimed in claim 12, wherein the bottom ring, the top ring, and the bridge are in one piece.

14. The ring assembly as claimed in claim 8, wherein the bottom ring, the top ring, and the bridge are in one piece.

* * * * *